US011715431B2

(12) United States Patent
Xiao

(10) Patent No.: US 11,715,431 B2
(45) Date of Patent: Aug. 1, 2023

(54) BACKLIGHT MODULE AND DRIVING METHOD THEREOF USING SUBFIELDS WITH DIFFERENT DURATIONS

(71) Applicant: TCL CHINA STAR OPTOELECTRONICS TECHNOLOGY CO., LTD., Guangdong (CN)

(72) Inventor: Guangxing Xiao, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 329 days.

(21) Appl. No.: 17/055,587

(22) PCT Filed: Oct. 15, 2020

(86) PCT No.: PCT/CN2020/121220
§ 371 (c)(1),
(2) Date: Nov. 15, 2020

(87) PCT Pub. No.: WO2022/047901
PCT Pub. Date: Mar. 10, 2022

(65) Prior Publication Data

US 2022/0358888 A1 Nov. 10, 2022

(30) Foreign Application Priority Data

Sep. 2, 2020 (CN) ..... 202010910394.X

(51) Int. Cl.

| | |
|---|---|
| ***G09G 3/34*** | (2006.01) |
| ***G09G 3/32*** | (2016.01) |
| ***G09G 3/36*** | (2006.01) |
| ***G09G 3/20*** | (2006.01) |

(52) U.S. Cl.
CPC ..... *G09G 3/3426* (2013.01); *G09G 3/32* (2013.01); *G09G 3/3611* (2013.01); (Continued)

(58) Field of Classification Search
CPC ..... G09G 3/2007; G09G 3/2018–204; G09G 3/32–3258; G09G 3/34–3426; (Continued)

(56) References Cited

U.S. PATENT DOCUMENTS 5,184,117 A * 2/1993 Gauthier ..... G09G 3/3406 345/204
2005/0013582 A1 1/2005 Depovere et al.
(Continued)

FOREIGN PATENT DOCUMENTS

CN 1845226 A 10/2006
CN 101630476 A 1/2010
(Continued)

*Primary Examiner* — Keith L Crawley
(74) *Attorney, Agent, or Firm* — PV IP PC; Wei Te Chung; Zhigang Ma

(57) ABSTRACT

A backlight module and a driving method thereof are provided. The driving method includes following steps: first obtaining backlight data with N bits of data corresponding to each backlight unit in a current frame; then dividing time required by each backlight unit in the current frame to obtain N subfields with different durations; and finally outputting the N subfields of each backlight unit in a preset order, and controlling a scan line corresponding to the backlight unit to perform at least two scans in a first subfield, and a time interval between adjacent scans is less than a second threshold.

10 Claims, 6 Drawing Sheets

(52) U.S. Cl.
CPC ... *G09G 3/2007* (2013.01); *G09G 2300/0842* (2013.01); *G09G 2310/08* (2013.01); *G09G 2320/0247* (2013.01); *G09G 2330/021* (2013.01)

(58) Field of Classification Search
CPC ..... G09G 3/36–3611; G09G 3/3648; G09G 3/3666; G09G 2300/08; G09G 2300/0842; G09G 2310/0237; G09G 2310/024; G09G 2310/08; G09G 2320/0233; G09G 2320/0247; G09G 2320/0266; G09G 2320/0646; G09G 2330/021; H05B 45/10; H05B 45/44–46; G02F 1/1336–133603; G02F 1/133611–133613
See application file for complete search history.

(56) References Cited

U.S. PATENT DOCUMENTS

| | | | | |
|---|---|---|---|---|
| 2006/0227253 | A1 | 10/2006 | Kim | |
| 2007/0252786 | A1 | 11/2007 | Ishii et al. | |
| 2008/0284719 | A1* | 11/2008 | Yoshida | G02F 1/13392 349/37 |
| 2010/0013802 | A1 | 1/2010 | Hosaka et al. | |
| 2010/0020002 | A1* | 1/2010 | Van Woudenberg | G09G 3/342 345/102 |
| 2015/0170562 | A1 | 6/2015 | In et al. | |
| 2018/0190186 | A1* | 7/2018 | Chen | G09G 3/3233 |
| 2019/0012964 | A1 | 1/2019 | He | |
| 2021/0337642 | A1* | 10/2021 | Wang | G09G 3/3426 |

FOREIGN PATENT DOCUMENTS

| | | | |
|---|---|---|---|
| CN | 101763811 | A | 6/2010 |
| CN | 107068048 | A | 8/2017 |
| CN | 107492336 | A | 12/2017 |
| CN | 110517630 | A | 11/2019 |
| CN | 111341265 | A | 6/2020 |
| CN | 111445868 | A | 7/2020 |
| KR | 100869779 | B1 | 11/2008 |
| WO | 03046878 | A1 | 6/2003 |

* cited by examiner

BACKLIGHT MODULE AND DRIVING METHOD THEREOF USING SUBFIELDS WITH DIFFERENT DURATIONS

FIELD OF INVENTION

The present invention relates to the field of display technologies, and in particular, to a backlight module and a driving method thereof.

BACKGROUND OF INVENTION

Due to their small sizes, mini-LED backlights can achieve ultra-thin and multi-zone drive characteristics, and have been widely used as backlight sources of liquid crystal display panels. Current mini-LED backlight modules use PWM dimming to improve display effect. Specifically, scanning time of a frame of display screens is divided into n subfields with different sizes, and n-bit data provided by a front-end timing controller TCON or FPGA is displayed in the n subfields. Each bit of the n-bit data is displayed by one of the n subfields, and a high-bit data is displayed in a subfield with longer duration, and a low-bit data is displayed in a subfield with shorter duration. Therefore, when there is a need to display high grayscale, it is in the subfield with longer duration. However, in backlight driving circuits corresponding to mini-LEDs, a storage capacitor will leak when time elapses after charging, which will cause high grayscale brightness displayed in the subfield with longer duration to be darker than low grayscale brightness displayed only in the subfield with shorter duration, and affect the display effect.

Therefore, the current mini-LED backlight modules have a technical problem that the low grayscale brightness is greater than the high grayscale brightness, which needs to be improved.

TECHNICAL PROBLEM

An embodiment of the present invention provides a backlight module and a driving method of the backlight module to alleviate a technical problem that low grayscale brightness is greater than high grayscale brightness in current mini-LED backlight modules.

TECHNICAL SOLUTION

In order to solve the above problems, technical solutions provided by the present invention are as follows:

The present invention provides a driving method of a backlight module, wherein the backlight module comprises a plurality of backlight units disposed in an array, and each backlight unit is arranged corresponding to a partition of a liquid crystal display panel, the driving method comprising following steps:

obtaining backlight data corresponding to each backlight unit in a current frame, wherein the backlight data comprises N bits of data, and N is a positive integer;

dividing time required by each backlight unit in the current frame to obtain N subfields with different durations, wherein each subfield is configured to display one bit of data; and outputting the N subfields of each backlight unit in a preset order, and controlling a scan line corresponding to each backlight unit to scan once in each subfield, wherein multiple subfields corresponding to at least one backlight unit comprise a first subfield with a duration greater than a first threshold, the scan line corresponding to the backlight unit is controlled to perform at least two scans in the first subfield, and a time interval between adjacent scans is less than a second threshold.

In the driving method of the backlight module of the present invention, the step that the multiple subfields corresponding to the at least one backlight unit comprise the first subfield with the duration greater than the first threshold, the scan line corresponding to the backlight unit is controlled to perform the at least two scans in the first subfield, and the time interval between the adjacent scans is less than the second threshold comprises:

the multiple subfields corresponding to the at least one backlight unit comprise at least two first subfields whose durations are greater than the first threshold, and the scan line corresponding to the backlight unit is controlled to perform an equal number of scans in each first subfield.

In the driving method of the backlight module of the present invention, the step that the multiple subfields corresponding to the at least one backlight unit comprise the first subfield with the duration greater than the first threshold, the scan line corresponding to the backlight unit is controlled to perform the at least two scans in the first subfield, and the time interval between the adjacent scans is less than the second threshold comprises:

the multiple subfields corresponding to the at least one backlight unit comprise at least two first subfields whose durations are greater than the first threshold, a number of scans performed by the scan line corresponding to the backlight unit in each first subfield is controlled to increase with an increase of the corresponding duration of the first subfield.

In the driving method of the backlight module of the present invention, the step that the multiple subfields corresponding to the at least one backlight unit comprise the first subfield with the duration greater than the first threshold, the scan line corresponding to the backlight unit is controlled to perform the at least two scans in the first subfield, and the time interval between the adjacent scans is less than the second threshold comprises:

the multiple subfields corresponding to the at least one backlight unit comprise at least two first subfields whose durations are greater than the first threshold, the scan line corresponding to the backlight unit is controlled to perform at least two scans in each first subfield, wherein corresponding to different first subfields, the time intervals between the adjacent scans are equal.

In the driving method of the backlight module of the present invention, the step of dividing the time required by each backlight unit in the current frame to obtain the N subfields with different durations comprises:

arranging the N subfields in order from short to long in duration, a duration of a j-th subfield is $2j-1$ times the duration of the first subfield, wherein j is an integer greater than 1 and less than or equal to N.

In the driving method of the backlight module of the present invention, the step of dividing the time required by each backlight unit in the current frame to obtain the N subfields with different durations, wherein each subfield is configured to display one bit of data comprises:

arranging the N subfields in order from short to long in duration and arranging the N bits of data in the backlight data from low to high, wherein an i-th subfield is configured to display an i-th bit of data, i is an integer greater than or equal to 1 and less than or equal to N, and N is an integer greater than or equal to 7 and less than or equal to 12.

In the driving method of the backlight module of the present invention, the step of outputting the N subfields of each backlight unit in the preset order, and controlling the scan line corresponding to each backlight unit to scan once in each subfield comprises:

outputting the N subfields of each backlight unit in order from short to long in duration, wherein when each subfield is output, each scan line corresponding to the backlight unit is scanned once in turn.

In the driving method of the backlight module of the present invention, the step of outputting the N subfields of each backlight unit in the preset order comprises:

outputting the N subfields of each backlight unit at a preset frequency, and the preset frequency being twice a display frequency of the liquid crystal display panel.

In the driving method of the backlight module of the present invention, the step of outputting the N subfields of each backlight unit at the preset frequency, and the preset frequency being twice the display frequency of the liquid crystal display panel comprises:

synchronizing a frame start signal of the backlight unit with a frame start signal of the liquid crystal display panel before a start of each frame of the liquid crystal display panel.

In the driving method of the backlight module of the present invention, the step of obtaining the backlight data corresponding to each backlight unit in the current frame comprises:

obtaining the backlight data corresponding to each backlight unit in the current frame from a timing controller or a field programmable gate array.

The present invention further provides a backlight module, the backlight module comprises a plurality of backlight units disposed in an array, wherein each backlight unit is arranged corresponding to a partition of a liquid crystal display panel, and the backlight module comprises:

an obtaining module configured to obtain backlight data corresponding to each backlight unit in a current frame, wherein the backlight data comprises N bits of data, and N is a positive integer;

a dividing module configured to divide each backlight unit in time required by the current frame to obtain N subfields with different durations, wherein each subfield is configured to display one bit of data; and an output module configured to output the N subfields of each backlight unit in a preset order, and control a scan line corresponding to each backlight unit to scan once in each subfield, wherein multiple subfields corresponding to at least one backlight unit comprise a first subfield with a duration greater than a first threshold, the scan line corresponding to the backlight unit is controlled to perform at least two scans in the first subfield, and a time interval between adjacent scans is less than a second threshold.

In the backlight module of the present invention, the multiple subfields corresponding to the at least one backlight unit comprise at least two first subfields whose durations are greater than the first threshold, and the output module is configured to control the scan line corresponding to the backlight unit to have an equal number of scans in each first subfield.

In the backlight module of the present invention, the multiple subfields corresponding to the at least one backlight unit comprise at least two first subfields whose durations are greater than the first threshold, and the output module is configured to control a number of scans performed by the scan line corresponding to the backlight unit in each first subfield to increase with an increase of the corresponding duration of the first subfield.

In the backlight module of the present invention, the multiple subfields corresponding to the at least one backlight unit comprise at least two first subfields whose durations are greater than the first threshold, and the output module is configured to control the scan line corresponding to the backlight unit to perform at least two scans in each first subfield, wherein corresponding to different first subfields, the time intervals between the adjacent scans are equal.

In the backlight module of the present invention, the dividing module is configured to arrange the N subfields in order from short to long in duration, a duration of a j-th subfield is $2j-1$ times the duration of the first subfield, wherein j is an integer greater than 1 and less than or equal to N.

In the backlight module of the present invention, the dividing module is configured to arrange the N subfields in order from short to long in duration, and arrange the N bits of data in the backlight data from low to high, wherein an i-th subfield is configured to display an i-th bit of data, i is an integer greater than or equal to 1 and less than or equal to N, and N is an integer greater than or equal to 7 and less than or equal to 12.

In the backlight module of the present invention, the output module is configured to output the N subfields of each backlight unit in order from short to long in duration, wherein when each subfield is output, each scan line corresponding to the backlight unit is scanned once in turn.

In the backlight module of the present invention, the output module is configured to output the N subfields of each backlight unit at a preset frequency, and the preset frequency being twice a display frequency of the liquid crystal display panel.

In the backlight module of the present invention, the output module is configured to synchronize a frame start signal of the backlight unit with a frame start signal of the liquid crystal display panel before a start of each frame of the liquid crystal display panel.

In the backlight module of the present invention, the obtaining module is configured to obtain the backlight data corresponding to each backlight unit in the current frame from a timing controller or a field programmable gate array.

BENEFICIAL EFFECT

Beneficial effects of the present invention are: the present invention provides a backlight module and a driving method of the backlight module. The backlight module comprises a plurality of backlight units disposed in an array, and each backlight unit is arranged corresponding to a partition of a liquid crystal display panel. The driving method comprising following steps: obtaining backlight data corresponding to each backlight unit in a current frame, wherein the backlight data comprises N bits of data, and N is a positive integer; dividing time required by each backlight unit in the current frame to obtain N subfields with different durations, wherein each subfield is configured to display one bit of data; and outputting the N subfields of each backlight unit in a preset order, and controlling a scan line corresponding to each backlight unit to scan once in each subfield, wherein multiple subfields corresponding to at least one backlight unit comprise a first subfield with a duration greater than a first threshold, the scan line corresponding to the backlight unit is controlled to perform at least two scans in the first subfield, and a time interval between adjacent scans is less than a second threshold. In the present invention, a scanning line corresponding to the backlight unit is scanned at least twice in the first subfield with longer duration, so that a storage capacitor corresponding to the backlight unit can be charged again before being discharged. Therefore, stability of voltages at two ends of the storage capacitor is maintained, so that backlight data with high grayscale will not be dimmed in the first subfield, thereby alleviating a technical problem that low grayscale brightness is greater than high grayscale brightness.

DESCRIPTION OF DRAWINGS

In order to more clearly illustrate the embodiments or the technical solutions in the prior art, a brief introduction of the drawings used in the embodiments or the prior art description will be briefly described below. Obviously, the drawings in the following description are only some of the embodiments of the invention, and those skilled in the art can obtain other drawings according to the drawings without any creative work.

DETAILED DESCRIPTION OF PREFERRED EMBODIMENTS

The following description of the various embodiments is provided with reference to the accompanying drawings. Directional terms, such as upper, lower, front, back, left, right, inner, outer, and lateral side, mentioned in the present invention are only for reference. Therefore, the directional terms are used for describing and understanding rather than limiting the present invention. In the figures, units having similar structures are used for the same reference numbers.

An embodiment of the present invention provides a backlight module and a driving method of the backlight module to alleviate a technical problem that low grayscale brightness is greater than high grayscale brightness in current Mini LED backlight modules.

Figure 1:
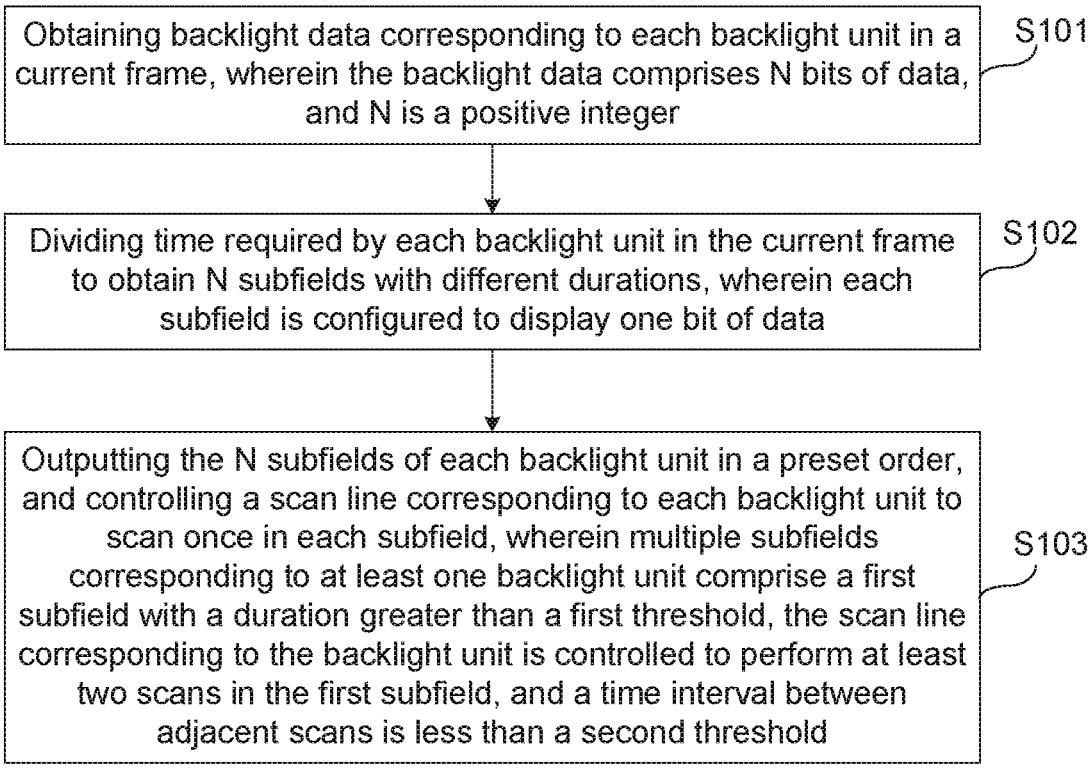
FIG. 1 is a schematic flowchart of a driving method of a backlight module provided by an embodiment of the present invention.

The present invention provides the driving method of the backlight module. The backlight module comprises a plurality of backlight units disposed in an array, and each backlight unit is arranged corresponding to a partition of a liquid crystal display panel. As shown in FIG. 1, the driving method comprising following steps:

S101: obtaining backlight data corresponding to each backlight unit in a current frame, wherein the backlight data comprises N bits of data, and N is a positive integer;

S102: dividing time required by each backlight unit in the current frame to obtain N subfields with different durations, wherein each subfield is configured to display one bit of data; and S103: outputting the N subfields of each backlight unit in a preset order, and controlling a scan line corresponding to each backlight unit to scan once in each subfield, wherein multiple subfields corresponding to at least one backlight unit comprise a first subfield with a duration greater than a first threshold, the scan line corresponding to the backlight unit is controlled to perform at least two scans in the first subfield, and a time interval between adjacent scans is less than a second threshold.

The driving method will be described in detail below with reference to FIG. 2 to FIG. 9.

In S101, obtaining the backlight data corresponding to each backlight unit in the current frame, wherein the backlight data comprises the N bits of data, and N is the positive integer.

Figure 2:
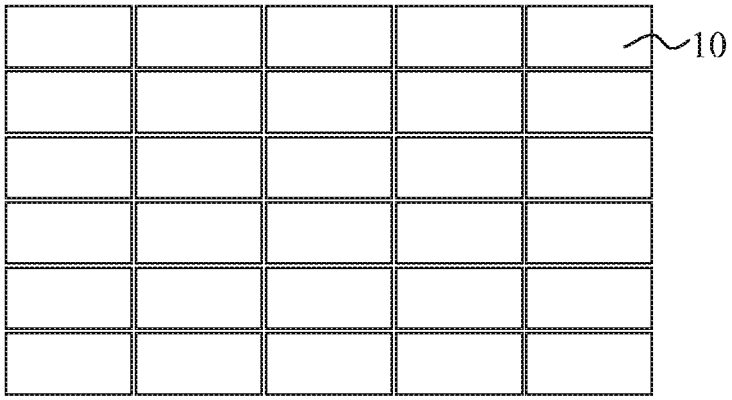
FIG. 2 is a plane structural view of the backlight module provided by the embodiment of the present invention.
Figure 3:
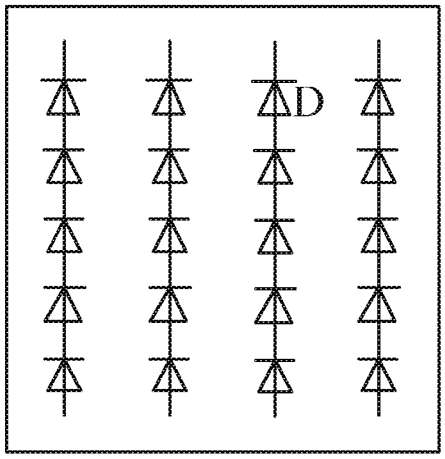
FIG. 3 is a schematic structural view of a backlight unit in the backlight module provided by the embodiment of the present invention.

As shown in FIG. 2, the backlight module is formed by splicing multiple backlight units 10, each backlight unit 10 is arranged corresponding to the partition of the liquid crystal display panel, and each backlight unit 10 can emit light independently. As shown in FIG. 3, each backlight unit 10 comprises light emitting devices D disposed in an array. The light emitting devices D can be connected in series, and the light emitting devices D can be mini-LED lamps.

Figure 4:
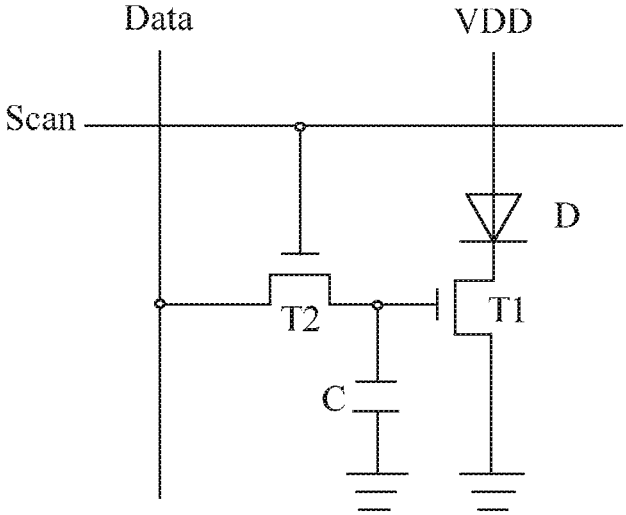
FIG. 4 is a schematic structural view of a backlight driving circuit corresponding to the backlight unit in the backlight module provided by the embodiment of the present invention.

The light emitting device D is driven by a backlight drive circuit. The backlight driving circuit is shown in FIG. 4, comprising a driving transistor T1, a switching transistor T2, and a storage capacitor C. A gate of the switching transistor T2 is connected to a scan line Scan, a first electrode of the switching transistor T2 is connected to a data line Data, and a second electrode of the switching transistor T2 is connected to a gate of the driving transistor T1 and a first plate of the storage capacitor C. A first electrode of the driving transistor T1 is connected to a first electrode of the light emitting device D, and a second electrode of the driving transistor T1 is grounded. A second electrode of the storage capacitor C is grounded, and a second electrode of the light emitting device D is connected to a power supply with high potential signal VDD.

When the backlight unit 10 provides backlight for the liquid crystal display panel, a working process is divided into a data writing stage and a light emitting stage. In the data writing stage, a scanning signal input by the scanning line Scan corresponding to the backlight unit 10 is at a high potential, the switching transistor T2 is turned on, and the data signal is written into the gate of the driving transistor T1 and stored in the storage capacitor C. In the light emitting stage, the scan signal input by the scan line Scan is at a low potential, the switching transistor T2 is turned off, and a writing of the data signal is stopped. The driving transistor T1 is kept turned on by the storage capacitor C to drive the light emitting device D to emit light. By adjusting a size of an input data signal, current flowing through the light emitting device D can be controlled, and then light emitting brightness of the light emitting device D can be controlled, so that the light emitting device D can display different grayscales.

Each backlight unit 10 comprises multiple parallel scan lines and multiple parallel data lines, and the scan lines are insulated from the data lines and intersect perpendicularly. Each light emitting device D in the backlight unit 10 is connected to one of the scan lines and one of the data lines, a same row of light emitting devices D is connected to a same scan line, and a same column of light emitting devices D is connected to a same data line.

For each backlight unit 10, there is a corresponding grayscale when displaying a frame. A value of the grayscale is represented by the backlight data. The backlight data comprises the N bits of data, wherein N is a positive integer, and a value of each bit is 0 or 1. In the embodiment, a value of N is an integer greater than or equal to 7 and less than or equal to 12. Specifically, the backlight data of each backlight unit 10 can be obtained from a timing controller (Tcon) or a field programmable gate array (FPGA). The backlight data of each backlight unit 10 is obtained through algorithm processing based on a data information of screens to be displayed.

Each backlight unit 10 can emit light with different brightness. For example, when the backlight data corresponding to the backlight unit 10 is 7 bits, the backlight unit 10 can emit light with 128 different brightness, that is, a brightness corresponding to grayscale of 0-127. When the backlight data corresponding to the backlight unit 10 is 8 bits, the backlight unit 10 can emit light with 256 different brightnesses. When the backlight data corresponding to the backlight unit 10 is 10 bits, the backlight unit 10 can emit light with 1024 different brightness.

In S102, dividing the time required by each backlight unit in the current frame to obtain the N subfields with different durations, wherein each subfield is configured to display one bit of data.

In the present invention, the time required to display a frame of the screen is cut into non-equal spaced subfields to obtain the N subfields with different durations. A number of subfields is equal to a number of bits of the backlight data, and each subfield corresponds to displaying one bit of data. A duration of different bits indicates a contribution of different bits to the brightness of the backlight, that is, a weight of different bits. The longer the duration of each subfield, the greater the weight.

Specifically, arranging the N subfields in order from short to long in duration, a duration of a j-th subfield is $2^{j-1}$ times the duration of the first subfield, wherein j is an integer greater than 1 and less than or equal to N. Arranging the N bits of data in the backlight data from low to high, wherein an i-th subfield is configured to display an i-th bit of data, i is an integer greater than or equal to 1 and less than or equal to N, and N is an integer greater than or equal to 7 and less than or equal to 12.

Taking the backlight data comprising 7-bit data as an example, the number of subfields is also 7, and the number of grayscales that the backlight unit 10 can display is 128. Arrange the 7 subfields in an order from short to long, denoted as SF1, SF2, SF3, SF4, SF5, SF6, and SF7.

Figure 6:
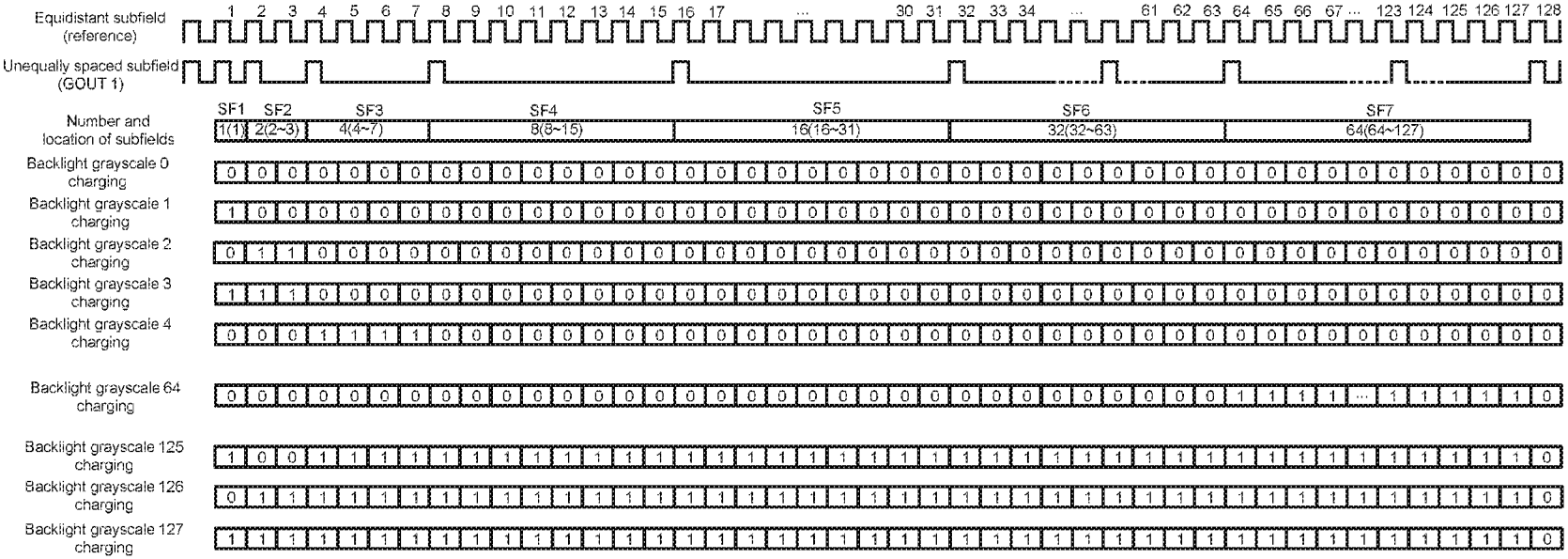
FIG. 6 is a schematic view of a driving principle of the backlight module provided by the embodiment of the present invention.

As shown in FIG. 6, in an equally spaced subfield cutting mode, the time required for each frame is cut into 128 subfields, the duration of each subfield is equal, and a time interval of each subfield is also equal. Taking the duration of each subfield in the equally spaced subfield cutting mode as a reference, a duration of SF1 is equal to a duration of 1 subfield in the equally spaced subfield. A duration of SF2 is equal to twice the duration of SF1, and corresponds to the time of the 2nd and 3rd subfields in the equally spaced subfields. A duration of SF3 is equal to 4 times the duration of SF1, and corresponds to the time of the 4th to 7th subfields in the equally spaced subfields. A duration of SF4 is equal to 8 times the duration of SF1, and corresponds to the time of the 8th to 15th subfields in the equally spaced subfields. A duration of SF5 is equal to 16 times the duration of SF1, and corresponds to the time of the 16th to 31st subfields in the equally spaced subfields. A duration of SF6 is equal to 32 times the duration of SF1, and corresponds to the time of the 32nd to 63rd subfields in the equally spaced subfields. A duration of SF7 is equal to 64 times the duration of SF1, and corresponds to the time of the 64th to 127th subfields in the equally spaced subfields.

A first bit of data from left to right in the backlight data is the highest bit, denoted as B[6]. A seventh bit of data is the lowest bit, denoted as B[0]. Each value in B[6] to B[0] is 0 or 1.

When using the subfields to display the bit of data, convert 7 bits of data into 128 bits. Wherein, SF1 displays data of B[0], and a number of data is $2^0$. SF2 displays data of B[1], and a number of data is $2^1$. SF3 displays data of B[2], and a number of data is $2^2$. SF4 displays data of B[3], and a number of data is $2^3$. SF5 displays data of B[4], and a number of data is $2^4$. SF6 displays data of B[5], and a number of data is $2^5$. SF7 displays data of B[6], and a number of data is $2^6$.

As shown in FIG. 6, when the backlight unit 10 is charged at 0 grayscale, 0 is displayed in SF1 to SF7. When the backlight unit 10 is charged at 1 grayscale, 1 is displayed in SF1, and 0 is displayed in SF2 to SF7. When the backlight unit 10 is charged at 64 grayscale, the corresponding 7-bit backlight data is 0110100. Wherein B[0] is 0, a number of 0 that SF1 displays is $2^0$, B[1] is 0, a number of 0 that SF2 displays is $2^1$, B[2] is 1, a number of 0 that SF3 displays is $2^2$, B[3] is 0, a number of 0 that SF4 displays is $2^3$, B[4] is 1, a number of 0 that SF5 displays is $2^4$, B[5] is 1, a number of 0 that SF6 displays is $2^5$, B[6] is 0, a number of 0 that SF7 displays is $2^6$. In addition, regardless of the size of the charging grayscale, a 128th subfield in the corresponding equidistant subfield always displays 0. When charging the other grayscales, each subfield is displayed in this way.

In S103, outputting the N subfields of each backlight unit in the preset order, and controlling the scan line corresponding to each backlight unit to scan once in each subfield, wherein the multiple subfields corresponding to the at least one backlight unit comprise the first subfield with the duration greater than the first threshold, the scan line corresponding to the backlight unit is controlled to perform the at least two scans in the first subfield, and the time interval between the adjacent scans is less than the second threshold.

After each subfield corresponds to the data of the bit to be displayed, the subfields are sequentially output in an order of duration from short to long, so that the backlight unit 10 display a bright state or a dark state according to a numerical value of the corresponding bit data in each subfield. Specifically, in each subfield of output, each scan line corresponding to each backlight unit 10 is scanned one time in turn, that is, a high potential is input one time in turn. When it is necessary to display 1 in the subfield, the input data signal is high, then the backlight unit 10 is in the bright state in the subfield. When it is necessary to display 0 in the subfield, the input data signal is low, then the backlight unit 10 is in the dark state in the subfield.

Figure 7:
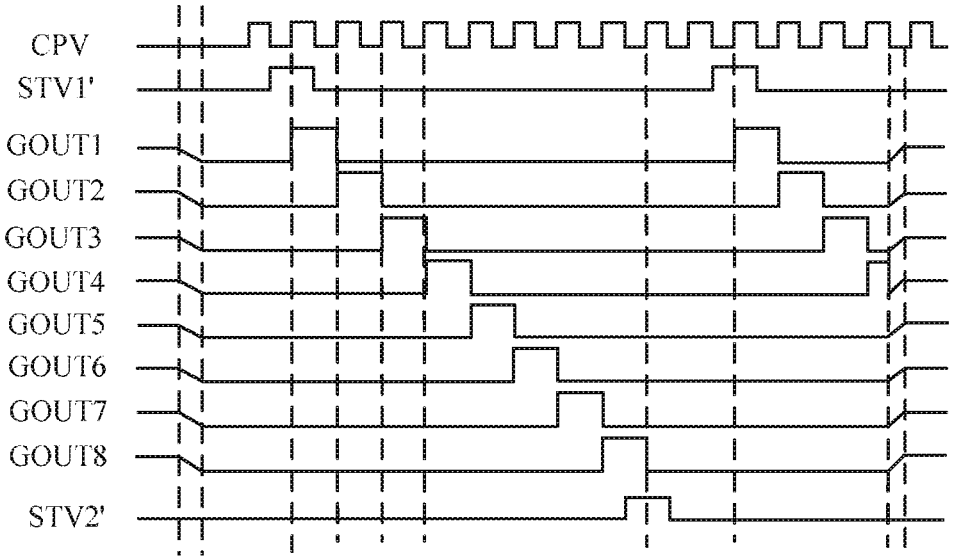
FIG. 7 is a timing diagram of each driving signal when the backlight module provided by the embodiment of the present invention is driven in an equally spaced subfield cutting mode.

As shown in FIG. 7, in the equally spaced subfield cutting mode, when the first subfield is output, the backlight unit 10 first outputs a first subfield start signal STV1', and then each scan line GOUT1 to GOUT8 in the backlight unit 10 scans once in turn, that is, outputs a high potential scan signal. A scanning start time of each scanning line in GOUT1 to GOUT8 corresponds to a rising edge of a gate row turn on signal CPV. At the same time, the data signal is also output, and the scanning signal and the data signal work together to make the light emitting device D work. When a GOUT8 scan is completed, an output of the first subfield is completed, and the second subfield is output in sequence. The backlight unit 10 outputs a second subfield start signal STV2', and then each scan line GOUT1 to GOUT8 in the backlight unit 10 performs a scan in turn, and cooperates with the data signal to complete an output of the second subfield. And so on, until an output of the last subfield is completed, a display screen with complete backlight is obtained.

It can be seen from FIG. 7 that in the equally spaced subfield cutting mode, the duration of each subfield is equal. Therefore, after the scanning signal and the data signal are input in each subfield, time for holding a capacitance of the storage capacitor C corresponding to the light-emitting device D is equal, and the time is relatively short, so there will be no discharge of the storage capacitor C.

Figure 5:
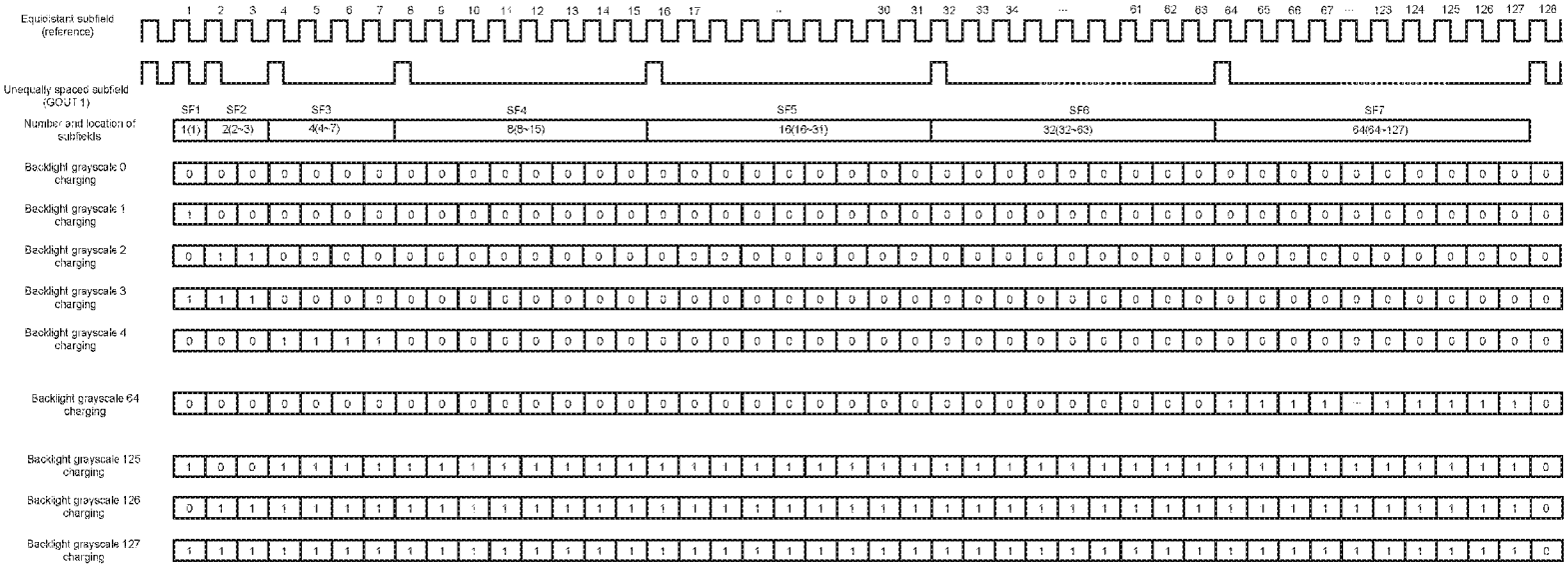
FIG. 5 is a schematic view of a driving principle of a backlight module in the prior art.
Figure 8:
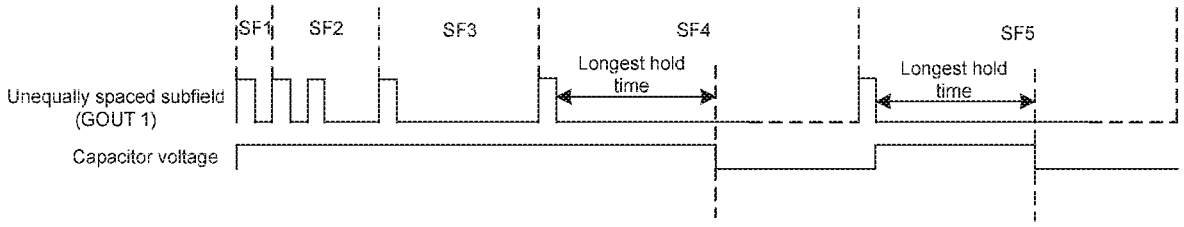
FIG. 8 is a schematic view of a discharge state of a storage capacitor in the backlight module provided by the embodiment of the present invention.

As shown in FIG. 5, in a non-equal spaced subfield cutting mode of the prior art, the duration of each subfield gradually increases. In each subfield, the scan line GOUT1 corresponding to the backlight unit 10 is also scanned once. As shown in FIG. 8, in the subfields with shorter duration such as SF1, SF2, and SF3, after the scan line GOUT1 is scanned once, remaining time in the subfield is shorter, and the storage capacitor C only needs to maintain the capacitance in a short period of time to maintain a light emission of the light emitting device D. When a next subfield is output, the scan line GOUT1 performs a next scan again, so the storage capacitor C can be kept in a non-discharged state. In the subfields with longer duration such as SF4 and SF5, after the scan line GOUT1 is scanned once, the remaining time in the subfield is longer and exceeds the longest retention time of the storage capacitor C. Voltages at two ends of the storage capacitor C will become smaller, which will cause the drive transistor T1 to be in a non-linear region. Current passes through the light emitting device D is unstable, and its brightness will be affected. Because data with high grayscale needs to be displayed in the subfield with longer duration, and low grayscale data only needs to be displayed in the subfield with shorter duration, when high grayscale data causes the storage capacitor C to discharge in the display device in the subfield with longer duration, display brightness under high grayscale will be lower than display brightness under low grayscale, which affects an effect of backlighting.

In the present invention, the first subfield with the duration greater than the first threshold is selected from the multiple subfields corresponding to at least one backlight unit 10, and the scan line corresponding to the backlight unit 10 is controlled to scan at least twice in the first subfield, and the time interval between the adjacent scans is less than the second threshold, so that the storage capacitor C corresponding to the backlight unit 10 can be charged again before discharging. Therefore, the voltages at the two ends of the storage capacitor C is kept stable, so that the backlight data with high grayscale in the first subfield does not appear brightness dimming, thereby alleviating the technical problem that that low grayscale brightness is greater than high grayscale brightness.

The duration of the first subfield is greater than the first threshold, and a value of the first threshold is greater than a sum of the scan time and a maximum retention time of the storage capacitor C. For a backlight unit 10, a number of the first subfield can be one, two or more. Specifically, different first thresholds can be set according to a difference of the scan time and the maximum retention time of the storage capacitor C, so as to determine the number of first subfields. A value of the second threshold is the maximum retention time of the storage capacitor C.

Take a waveform of the scan line GOUT1 in FIG. 6 as an example. After the scan line GOUT1 is scanned once in SF6 and SF7, the remaining time is greater than the maximum retention time of the storage capacitor C. Therefore, during the display of SF6 and SF7, a scan is added to SF6 and SF7, so that the backlight data with high grayscale is recharged the storage capacitor C before the storage capacitor C fails. Therefore, the voltages at two ends of the storage capacitor C is kept stable, and thus luminance of the light emitting device D in SF6 and SF7 does not decrease.

In an embodiment, the multiple subfields corresponding to the at least one backlight unit comprise at least two first subfields whose durations are greater than the first threshold, and the output module is configured to control the scan line corresponding to the backlight unit to have an equal number of scans in each first subfield. At this time, as shown in FIG. 6, the scan line corresponding to the backlight unit 10 has only been scanned twice in SF6 and SF7, that is, the scanning times in SF6 and SF7 are equal.

In an embodiment, the multiple subfields corresponding to the at least one backlight unit comprise at least two first subfields whose durations are greater than the first threshold, and the output module is configured to control a number of scans performed by the scan line corresponding to the backlight unit in each first subfield to increase with an increase of the corresponding duration of the first subfield. When the duration of the first subfield is longer, the remaining time of the scan line after the first scan is also longer. If another scan is performed in the first subfield with the shorter duration, the storage capacitor C can maintain the capacitance during an entire period of the subfield, then in the first subfield with the longer duration, even if another scan is performed, the maximum retention time of the storage capacitor C has been exceeded for a period of time after the end of the scan, and the time of the subfield has not yet ended, it may still reduce luminous brightness, so it is necessary to add one or more scans to maintain the stability of the voltages at the two ends of the storage capacitor C. In this case, the scan times of the scan line in each first subfield need to increase as the corresponding first subfield increases.

In an embodiment, the multiple subfields corresponding to the at least one backlight unit comprise at least two first subfields whose durations are greater than the first threshold, and the output module is configured to control the scan line corresponding to the backlight unit to perform at least two scans in each first subfield, wherein corresponding to different first subfields, the time intervals between the adjacent scans are equal. Since an increased number of the scans in each first subfield is to keep the voltages at two ends of the storage capacitor C stable, and the time interval between the adjacent scans is less than the second threshold, the time interval of the adjacent scans in different first subfields is set to be equal, and parameters of the input interval can be set only once, which is convenient and easy to operate.

Figure 9:
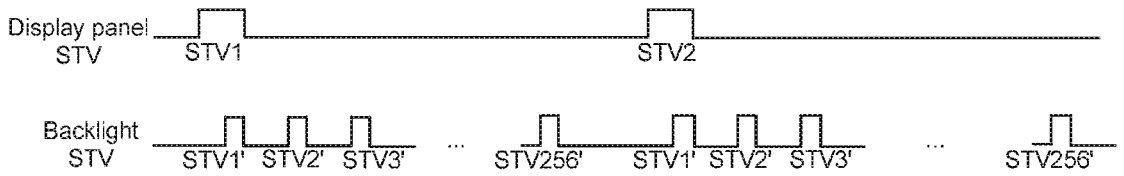
FIG. 9 is a schematic view of a frequency comparison between the backlight unit and a liquid crystal display panel provided by the embodiment of the present invention.

In an embodiment, the output module is configured to output the N subfields of each backlight unit 10 at a preset frequency, and the preset frequency being twice a display frequency of the liquid crystal display panel. As shown in FIG. 9, taking the equally spaced subfield cutting mode as an example, 7-bit backlight data corresponds to 128 subfields. When the LCD panel starts to input a first frame start signal STV1, the backlight unit 10 also starts to input a first subfield start signal STV1', until the backlight unit 10 inputs a 256th subfield start signal STV256', a frame of the liquid crystal display panel ends. In the backlight unit 10, STV1' to STV128' are the first frame, STV129' to STV256' are the second frame, that is, the liquid crystal display panel displays one frame, and the backlight unit 10 displays two frames. Then the liquid crystal display panel starts to input a second frame start signal STV2, and backlight unit 10 also starts to input each subfield start signal corresponding to each of the next two frames. Outputting the output frequency of the N subfields of each backlight unit 10 at twice the display frequency of the liquid crystal display panel can make the human eyes not feel the flicker of the backlight, and the display effect is better. In the present invention, when the backlight data is 7 bits, the display frequency of the liquid crystal display panel is 120 HZ, and the display frequency of the backlight unit 10 is 240 HZ.

In addition, before the start of each frame of the liquid crystal display panel, a frame start signal of the backlight unit 10 needs to be synchronized with a frame start signal of the liquid crystal display panel, so that the display of the backlight unit 10 and the display of the liquid crystal display panel can be matched with each other, and a display effect is improved. In FIG. 9, the first subfield start signal STV1' of the backlight unit 10 is also used as the first frame start signal of the backlight unit 10. During synchronization, the time interval between the first subfield start signal STV1 of the liquid crystal display panel and the first subfield start signal STV1' of the backlight unit 10 ranges from 1500 ns to a time of a subfield.

Figure 10:
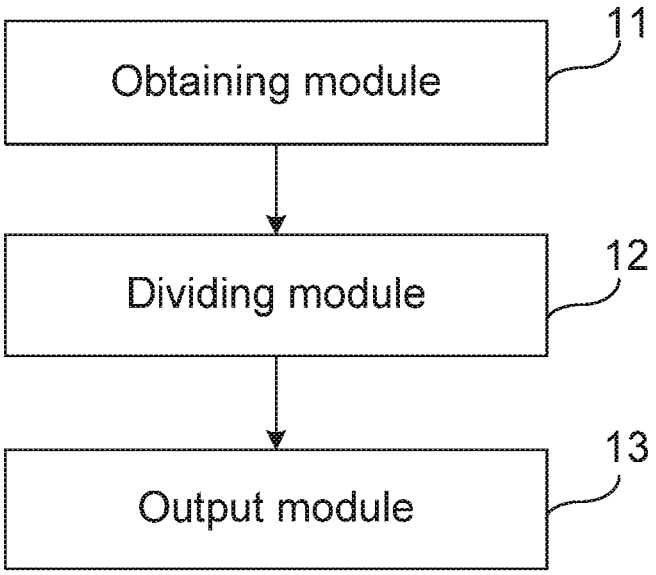
FIG. 10 is a schematic structural view of the backlight module provided by the embodiment of the present invention.

The present invention further provides a backlight module comprising the plurality of backlight units disposed in an array, wherein each backlight unit is arranged corresponding to the partition of the liquid crystal display panel. As shown in FIG. 10, the backlight module comprises:

an obtaining module 11 configured to obtain backlight data corresponding to each backlight unit in a current frame, wherein the backlight data comprises N bits of data, and N is a positive integer;

a dividing module 12 configured to divide each backlight unit in time required by the current frame to obtain N subfields with different durations, wherein each subfield is configured to display one bit of data; and an output module 13 configured to output the N subfields of each backlight unit in a preset order, and control a scan line corresponding to each backlight unit to scan once in each subfield, wherein multiple subfields corresponding to at least one backlight unit comprise a first subfield with a duration greater than a first threshold, the scan line corresponding to the backlight unit is controlled to perform at least two scans in the first subfield, and a time interval between adjacent scans is less than a second threshold.

In an embodiment, the multiple subfields corresponding to the at least one backlight unit comprise the at least two first subfields whose durations are greater than the first threshold, and the output module 13 is configured to control the scan line corresponding to the backlight unit to have the equal number of scans in each first subfield.

In an embodiment, the multiple subfields corresponding to the at least one backlight unit comprise the at least two first subfields whose durations are greater than the first threshold, and the output module 13 is configured to control the number of scans performed by the scan line corresponding to the backlight unit in each first subfield to increase with the increase of the corresponding duration of the first subfield.

In an embodiment, the multiple subfields corresponding to the at least one backlight unit comprise the at least two first subfields whose durations are greater than the first threshold, and the output module 13 is configured to control the scan line corresponding to the backlight unit to perform the at least two scans in each first subfield, wherein corresponding to the different first subfields, the time intervals between the adjacent scans are equal.

In an embodiment, the dividing module 12 is configured to arrange the N subfields in order from short to long in duration, a duration of a j-th subfield is $2^{j-1}$ times the duration of the first subfield, wherein j is an integer greater than 1 and less than or equal to N.

In an embodiment, the dividing module 12 is configured to arrange the N subfields in order from short to long in duration, and arrange the N bits of data in the backlight data from low to high, wherein an i-th subfield is configured to display an i-th bit of data, i is an integer greater than or equal to 1 and less than or equal to N, and N is an integer greater than or equal to 7 and less than or equal to 12.

In an embodiment, the output module 13 is configured to output the N subfields of each backlight unit in order from short to long in duration, wherein when each subfield is output, each scan line corresponding to the backlight unit is scanned once in turn.

In an embodiment, the output module 13 is configured to output the N subfields of each backlight unit at a preset frequency, and the preset frequency being twice a display frequency of the liquid crystal display panel.

In an embodiment, the output module 13 is configured to synchronize a frame start signal of the backlight unit with a frame start signal of the liquid crystal display panel before a start of each frame of the liquid crystal display panel.

In an embodiment, the obtaining module 11 is configured to obtain the backlight data corresponding to each backlight unit in the current frame from a timing controller or a field programmable gate array.

Each module in the backlight module of the present invention is driven by the driving method described in any of the above embodiments, thus alleviating the technical problem that the low grayscale brightness is greater than the high grayscale brightness in current backlight modules.

According to the above embodiments, it can be known that:

The present invention provides a backlight module and a driving method of the backlight module. The backlight module comprises a plurality of backlight units disposed in an array, and each backlight unit is arranged corresponding to a partition of a liquid crystal display panel. The driving method comprising following steps: obtaining backlight data corresponding to each backlight unit in a current frame, wherein the backlight data comprises N bits of data, and N is a positive integer; dividing time required by each backlight unit in the current frame to obtain N subfields with different durations, wherein each subfield is configured to display one bit of data; and outputting the N subfields of each backlight unit in a preset order, and controlling a scan line corresponding to each backlight unit to scan once in each subfield, wherein multiple subfields corresponding to at least one backlight unit comprise a first subfield with a duration greater than a first threshold, the scan line corresponding to the backlight unit is controlled to perform at least two scans in the first subfield, and a time interval between adjacent scans is less than a second threshold. In the present invention, the scanning line corresponding to the backlight unit is scanned at least twice in the first subfield with longer duration, so that a storage capacitor corresponding to the backlight unit can be charged again before being discharged. Therefore, stability of voltages at two ends of the storage capacitor is maintained, so that backlight data with high grayscale will not be dimmed in the first subfield, thereby alleviating a technical problem that low grayscale brightness is greater than high grayscale brightness.

In the above-mentioned embodiments, the description of each embodiment has its own focus. For parts that are not described in detail in an embodiment, reference may be made to related descriptions of other embodiments.

The backlight module and the driving method of the backlight module provided by the embodiments of the present invention are described in detail above. In this article, specific examples are used to explain the principles and implementation of the present invention. The description of the above embodiments is only used to help understand the technical solutions and core ideas of the present invention. Those of ordinary skill in the art should understand that they can still modify the technical solutions described in the foregoing embodiments, or equivalently replace some of the technical features. However, these modifications or replacements do not cause the essence of the corresponding technical solutions to deviate from the scope of the technical solutions of the embodiments of the present invention.

What is claimed is:

1. A driving method of a backlight module, wherein the backlight module comprises a plurality of backlight units disposed in an array, and each backlight unit is arranged corresponding to a partition of a liquid crystal display panel, the driving method comprising following steps:

obtaining backlight data corresponding to each backlight unit in a current frame, wherein the backlight data comprises N bits of data, and N is a positive integer;

dividing time required by each backlight unit in the current frame to obtain N subfields with different durations, wherein each subfield is configured to display one bit of data; and outputting the N subfields of each backlight unit in a preset order, and controlling respective scan lines corresponding to each backlight unit to scan once in turn when each subfield is output, wherein multiple subfields corresponding to each of at least one of the backlight units comprise at least one first subfield with a duration greater than a first threshold, each of the scan lines corresponding to the backlight unit is controlled to perform at least two scans in each of the at least one first subfield, and a time interval between adjacent scans of the at least two scans is less than a second threshold, wherein each backlight unit comprises light emitting devices disposed in an array, the light emitting devices are driven by a backlight drive circuit, a value of the first threshold is greater than a sum of scan time of the scan line and a maximum retention time of a storage capacitor in the backlight drive circuit, and a value of the second threshold is the maximum retention time of the storage capacitor, and wherein in the N subfields corresponding to each of at least one of the backlight units, one scan is performed in multiple subfields of the N subfields before the at least one first subfield.

2. The driving method of the backlight module as claimed in claim 1, wherein the step that in the N subfields corresponding to each of at least one of the backlight units, the at least one first subfield with the duration greater than the first threshold is determined based on the first threshold, each of the scan lines corresponding to the backlight unit is controlled to perform the at least two scans in each of the at least one first subfield, and the time interval between adjacent scans of the at least two scans is less than the second threshold comprises:

the N subfields corresponding to each of at least one of the backlight units comprise at least two first subfields whose durations are greater than the first threshold, and the scan lines corresponding to the backlight unit is controlled to perform an equal number of scans in each of the at least two first subfields.

3. The driving method of the backlight module as claimed in claim 1, wherein the step that in the N subfields corresponding to each of at least one of the backlight units, the at least one first subfield with the duration greater than the first threshold is determined based on the first threshold, each of the scan lines corresponding to the backlight unit is controlled to perform the at least two scans in each of the at least one first subfield, and the time interval between adjacent scans of the at least two scans is less than the second threshold comprises:

the N subfields corresponding to each of at least one of the backlight units comprise at least two first subfields whose durations are greater than the first threshold, a number of scans performed by each of the scan lines corresponding to the backlight unit in each of the at least two first subfields is controlled to increase with an increase of the corresponding duration of the first subfield.

4. The driving method of the backlight module as claimed in claim 1, wherein the step that in the N subfields corresponding to each of at least one of the backlight units, the at least one first subfield with the duration greater than the first threshold is determined based on the first threshold, each of the scan lines corresponding to the backlight unit is controlled to perform the at least two scans in each of the at least one first subfield, and the time interval between adjacent scans of the at least two scans is less than the second threshold comprises:

the N subfields corresponding to each of at least one of the backlight units comprise at least two first subfields whose durations are greater than the first threshold, each of the scan lines corresponding to the backlight unit is controlled to perform at least two scans in each of the at least two first subfields, wherein for different ones of the at least two first subfields, the time intervals between the adjacent scans are equal.

5. The driving method of the backlight module as claimed in claim 1, wherein the step of dividing the time required by each backlight unit in the current frame to obtain the N subfields with different durations comprises:

arranging the N subfields in order from short to long in duration, a duration of a j-th subfield is $2^{j-1}$ times the duration of the first subfield, wherein j is an integer greater than 1 and less than or equal to N.

6. The driving method of the backlight module as claimed in claim 5, wherein the step of dividing the time required by each backlight unit in the current frame to obtain the N subfields with different durations, wherein each subfield is configured to display one bit of data comprises:

arranging the N subfields in order from short to long in duration and arranging the N bits of data in the backlight data from low to high, wherein an i-th subfield is configured to display an i-th bit of data, i is an integer greater than or equal to 1 and less than or equal to N, and N is an integer greater than or equal to 7 and less than or equal to 12.

7. The driving method of the backlight module as claimed in claim 6, wherein the step of outputting the N subfields of each backlight unit in the preset order, and controlling the respective scan lines corresponding to each backlight unit to scan once in turn when each subfield is output comprises:

outputting the N subfields of each backlight unit in order from short to long in duration.

8. The driving method of the backlight module as claimed in claim 1, wherein the step of outputting the N subfields of each backlight unit in the preset order comprises:

outputting the N subfields of each backlight unit at a preset frequency, and the preset frequency being twice a display frequency of the liquid crystal display panel.

9. The driving method of the backlight module as claimed in claim 8, wherein the step of outputting the N subfields of each backlight unit at the preset frequency, and the preset frequency being twice the display frequency of the liquid crystal display panel comprises:

synchronizing a frame start signal of the backlight unit with a frame start signal of the liquid crystal display panel before a start of each frame of the liquid crystal display panel.

10. The driving method of the backlight module as claimed in claim 1, wherein the step of obtaining the backlight data corresponding to each backlight unit in the current frame comprises:

obtaining the backlight data corresponding to each backlight unit in the current frame from a timing controller or a field programmable gate array.

* * * * *